US009015862B2

(12) United States Patent
Wood

(10) Patent No.: US 9,015,862 B2
(45) Date of Patent: Apr. 28, 2015

(54) CUSHIONING PAD

(75) Inventor: John Wood, Wolverhampton (GB)

(73) Assignee: Redbacks Cushioning Ltd, Daventry (GB)

( * ) Notice: Subject to any disclaimer, the term of this patent is extended or adjusted under 35 U.S.C. 154(b) by 936 days.

(21) Appl. No.: 13/148,153

(22) PCT Filed: Feb. 5, 2010

(86) PCT No.: PCT/GB2010/000200

§ 371 (c)(1),
(2), (4) Date: Oct. 20, 2011

(87) PCT Pub. No.: WO2010/089556

PCT Pub. Date: Aug. 12, 2010

(65) Prior Publication Data

US 2012/0030850 A1 Feb. 9, 2012

(30) Foreign Application Priority Data

Feb. 5, 2009 (GB) ..... 0901923.3

(51) Int. Cl.

| | |
|---|---|
| ***A41D 13/00*** | (2006.01) |
| ***A41D 13/06*** | (2006.01) |
| ***A47C 7/02*** | (2006.01) |
| ***A47C 16/02*** | (2006.01) |

(52) U.S. Cl.
CPC ..... *A41D 13/065* (2013.01); *A47C 7/027* (2013.01); *A47C 16/02* (2013.01)

(58) Field of Classification Search
CPC ... A41D 13/065; A41D 13/06; A41D 13/055; A41D 13/0953; A63B 71/1225
USPC ..... 2/22, 23, 24
See application file for complete search history.

(56) References Cited

U.S. PATENT DOCUMENTS

| | | | | |
|---|---|---|---|---|
| 4,272,847 | A * | 6/1981 | Buhler | 2/463 |
| 4,422,183 | A * | 12/1983 | Landi et al. | 2/455 |
| 4,453,271 | A * | 6/1984 | Donzis | 2/456 |
| 4,610,034 | A * | 9/1986 | Johnson | 2/459 |
| 4,796,303 | A * | 1/1989 | Atwater | 2/24 |
| 5,168,576 | A | 12/1992 | Krent et al. | |
| 6,058,503 | A | 5/2000 | Williams | |
| 6,151,714 | A * | 11/2000 | Pratt | 2/24 |
| 6,156,000 | A * | 12/2000 | Chen et al. | 602/62 |
| 6,216,268 | B1 * | 4/2001 | Schleicher | 2/16 |
| 6,295,654 | B1 * | 10/2001 | Farrell | 2/456 |
| 6,336,220 | B1 | 1/2002 | Sacks et al. | |
| 2008/0289073 | A1 | 11/2008 | Jones | |

FOREIGN PATENT DOCUMENTS

| | | |
|---|---|---|
| FR | 794573 | 2/1936 |
| GB | 602645 | 5/1948 |
| WO | 9519881 A1 | 7/1995 |

* cited by examiner

*Primary Examiner* — Danny Worrell
(74) *Attorney, Agent, or Firm* — Rothwell, Figg, Ernst & Manbeck, P.C.

(57) ABSTRACT

The present invention relates to a knee pad and a knee pad assembly. A pad for cushioning the knee when kneeling on a surface comprises structure defining longitudinal first passageways with their longitudinal axes arranged to be positioned, in use, so that they intersect with the surface being knelt on.

20 Claims, 16 Drawing Sheets

CUSHIONING PAD

CROSS REFERENCE TO RELATED APPLICATION(S)

This application is a 35 U.S.C. §371 National Phase Entry Application from PCT/GB2010/000200, filed Feb. 5, 2010, designating the United States and also claims the benefit of Great Britain Application No. 0901923.3, filed Feb. 5, 2009, the disclosures of which are incorporated herein in its entirety by reference.

The present invention relates to a cushioning pad.

Knee pads are useful for people such as floorers, who must spend long periods of time kneeling on the floor. The knee pad provides cushioning and helps to minimise injuries to the knee caused by kneeling for long periods of time. A known knee pad comprises a piece of foam attached to a person's knee, so that when they kneel, the foam is compressed, thus cushioning the knee. However, over time, such foam knee pads tend to lose their resilience and become permanently compressed. Therefore, their efficiency at cushioning the wearer's knee is reduced.

According to the present invention there is provided a pad for cushioning the knee when kneeling on a surface, comprising structure defining longitudinal first passageways with their longitudinal axes arranged to be positioned, in use, so that they intersect with the surface being knelt on.

Preferably, the first passageways are arranged to be positioned, in use, substantially perpendicular to the surface being knelt on.

As the structure is made from solid material, rather than foam, it provides cushioning by flexing of the structure rather than by compression. The pad therefore shows improved compressive resilience over time than the known foam pad. In addition, the passageways allow air to circulate next to the knee, and therefore the pad is more breathable than the known foam pad, which may improve comfort for the user.

The first passageways are preferably arranged in an orderly formation. In other words, the formation is nonrandom. Preferably the first passageways are arranged in rows. Preferably all the first passageways have the same cross sectional area.

The structure may further define second passageways of a different size to the first passageways. The second passageways are preferably arranged in an orderly formation. In other words, the formation is nonrandom. The second passageways are preferably arranged in rows. The second passageways are preferably arranged in an alternate manner with the first passageways. Preferably, the second passageways are of a uniform cross sectional area.

Preferably, the first and second passageways together are arranged in an orderly formation. In other words, the formation is non-random.

Preferably, each first passageway has a cross sectional area between 10 $mm^2$ and 20 $mm^2$.

Preferably, each second passageway has a cross sectional area between 120 $mm^2$ and 140 $mm^2$.

The first passageways may be of any shape in cross section, but preferably are circular in cross section. The first passageways may be directly joined to each other, or may be joined via ribs, the ribs and outer edges of the first passageways defining the second passageways. Therefore, the structure comprises elements which are intended to flex (the ribs) and elements which are intended to provide rigidity (the walls of the first passageways).

Preferably, the ribs and the walls of the tubular elements are of the same thickness.

Preferably, the cross sectional area of each first passageway is less than 25% that each second passageway, more preferably less than 20%, and most preferably less than 16%.

The structure may be mesh-like in profile. Preferably, in profile, substantially perpendicular to the long axes of the passageways, the proportion of closed area of the structure to the total area of the structure is between 15% and 30%, more preferably between 18% and 26%, and most preferably between 21% and 23%. Therefore, there is only a small area of material in contact with the user's knee, further aiding the breatheability of the knee pad.

Preferably, the sides of the pad intended, in use, to be either side of the wearer's knee are curved in a direction which, in use, is away from the surface being knelt on.

Preferably, the pad has a first surface, the first surface being for contact with the knee and being concave in profile. The pad, therefore, is shaped to fit around the knee thus increasing the comfort of the wearer and reducing the likelihood of the pad slipping relative to the knee, and decreasing the bulkiness of the pad, when worn. Further, the curved sides allow greater freedom of movement over the surface being knelt on.

Preferably, the thickness of the knee pad is less than 40 mm. Therefore the thickness of the knee pad need not be substantially greater than that of the known foam pad.

The pad may further include a sheet member. The sheet member is preferably joined to tubular elements. The sheet member is preferably joined to ribs. The sheet member provides additional rigidity to the structure by reducing flexing in the structure.

The sheet member may be convex in profile, so that the apex of the arc of the sheet member faces towards the first surface. The sheet member therefore acts as a leaf spring. The sheet member therefore provides additional resilience to the structure.

Preferably, the radial centre of the arc defines an axis extending fore-aft.

The sheet member, alternatively, may be dome shaped.

Preferably, the sheet number is oriented so that the largest area of sheet member is visible when the sheet member is viewed from a plane parallel with the surface being knelt on.

Preferably, the sheet member is oriented so that at least half of its peripheral edge lies in a single plane, the plane being arranged to be substantially parallel, in use, to the surface being knelt on.

Therefore, the orientation of the sheet member, whether flat or not, is optimised to reduce flexing in the structure.

Preferably, the sheet member defines apertures which align with the centres of the first passageway, so that the first passageways are not blocked. Therefore, air can still circulate in the first passageway thus maintaining some breathability of the pad.

The sheet member is preferably thinner at the edges than in the centre. Preferably the thickness of the sheet member at the centre is between two to four times greater than at its edges, most preferably about three times greater.

The pad may be made from plastics material. The sheet member is preferably made of harder plastics material than the structure. This allows it to provide rigidity whilst the structure allows flexing. The structure is preferably made from a thermoplastic elastomer. Preferably, the structure is made from a material with a hardness of between 20 and 60 Shore A, and more preferably with a hardness of about 42 Shore A. The sheet member is preferably made from a thermoplastic elastomer. Preferably, the sheet member is made from a material with a hardness of between 50 and 90 Shore A, and more preferably with a hardness of about 70 Shore A.

According to another aspect of the present invention there is provided a knee pad assembly including a pad as previously described and means for attaching the pad to a person's leg. The means may comprise a holder with straps, the straps being suitable to wrap around a person's leg and keep the holder in the desired position on the leg.

According to a further aspect of the present invention there is provided the combination of a pad according to the first aspect of the present invention.

Two embodiments of the present invention will now be described by way of example and with reference to the accompanying drawings, in which.

Figure 1:
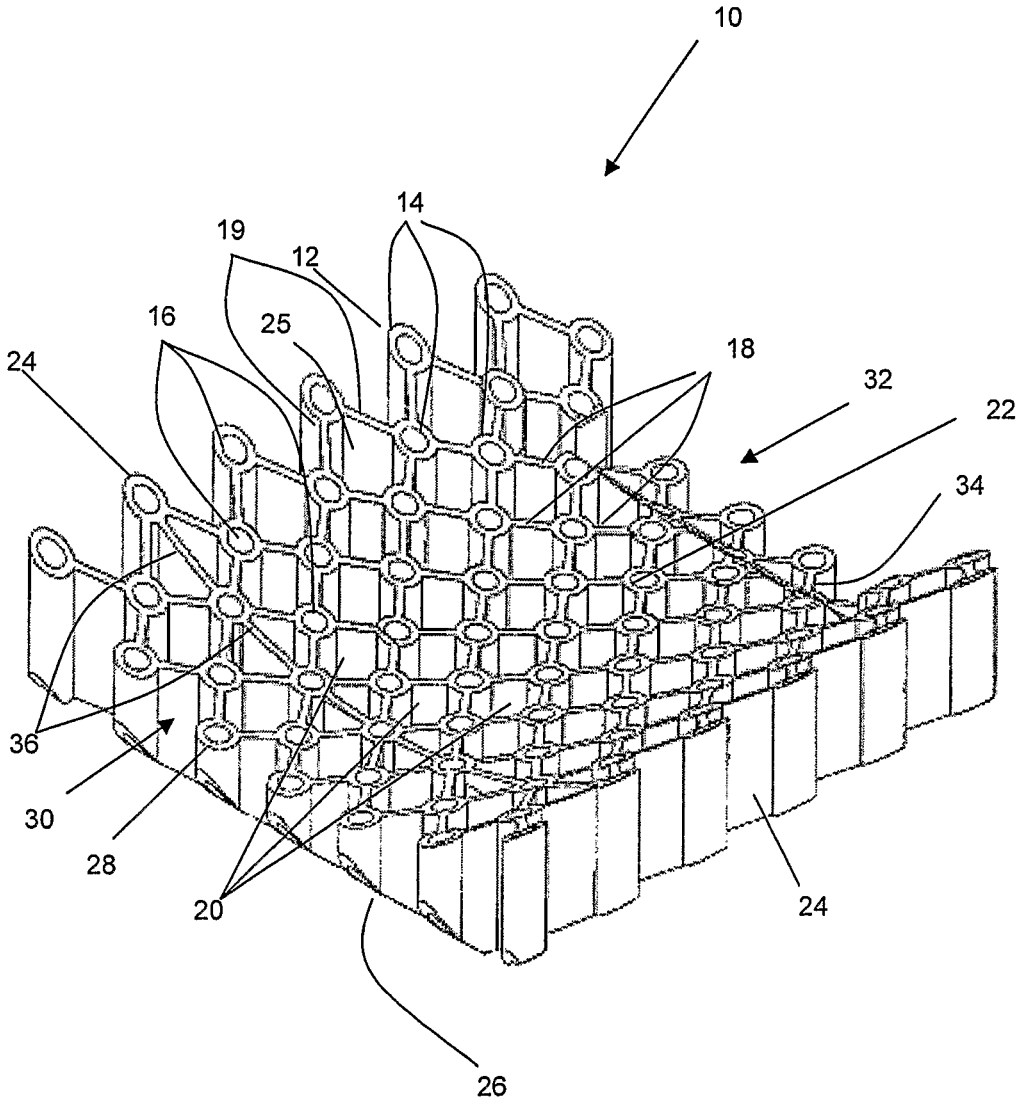
FIG. 1 is a perspective view of the pad of the first embodiment of the present invention, the pad being without the sheet member.
Figure 2:
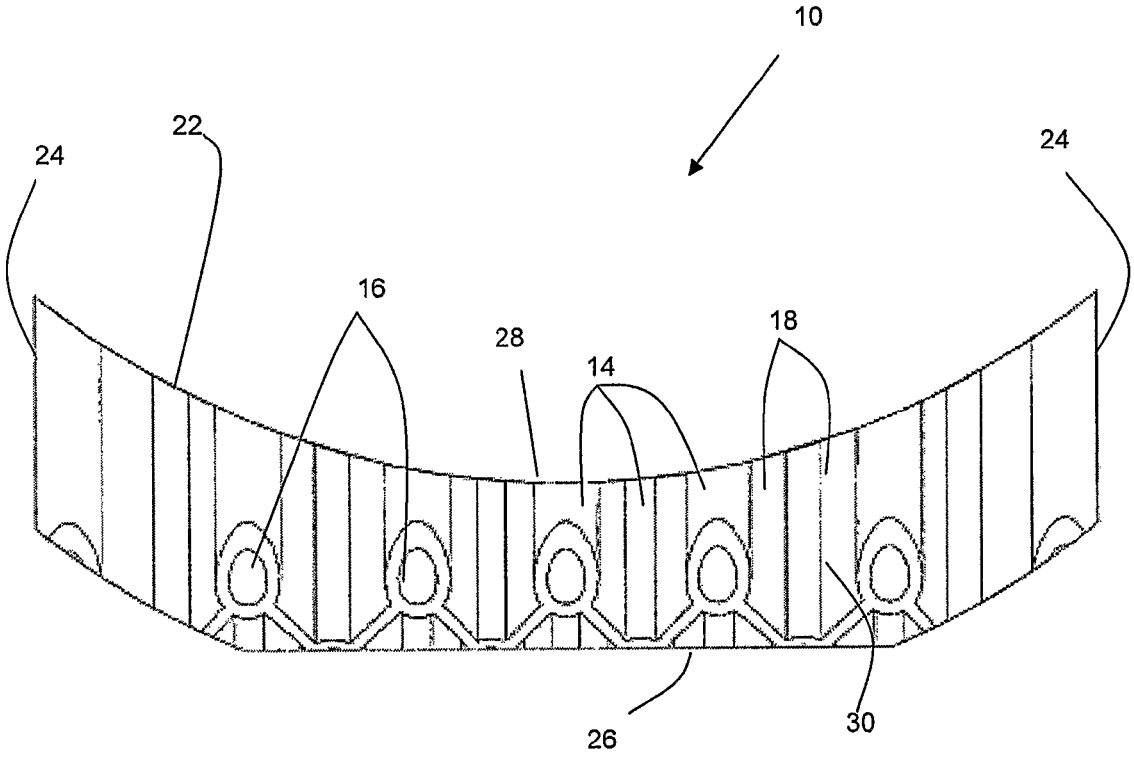
FIG. 2 is an end view of the pad of FIG. 1.
Figure 3:
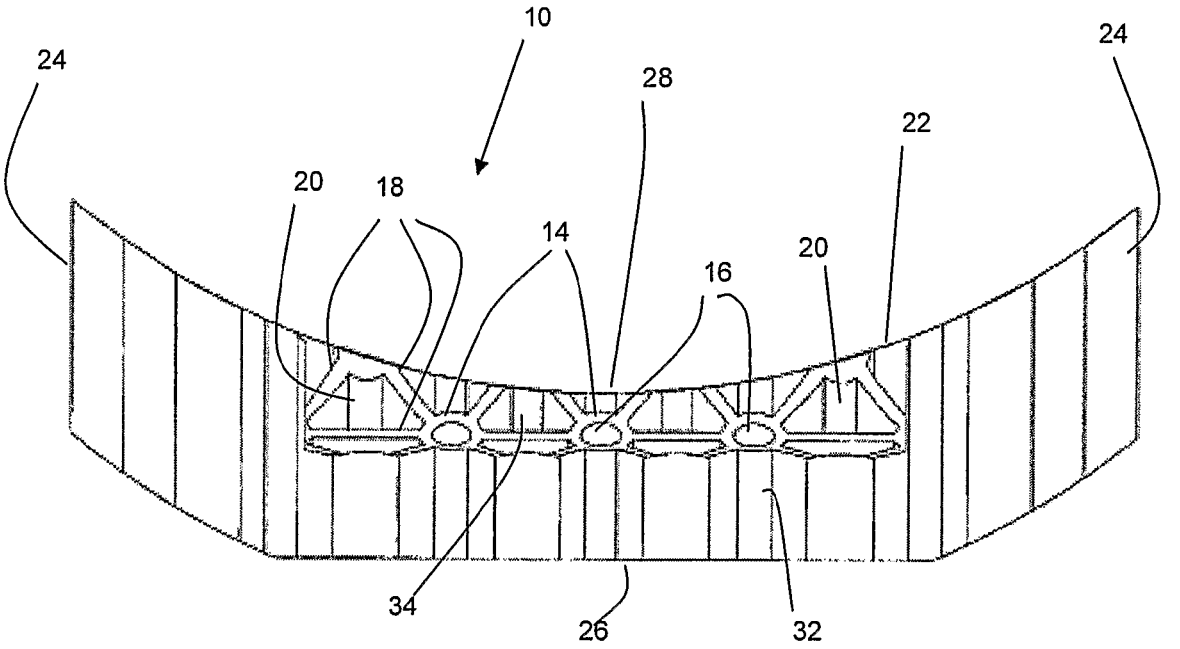
FIG. 3 is an end view of the pad of FIG. 1 from the end opposite to that shown in FIG. 2.
Figure 4:
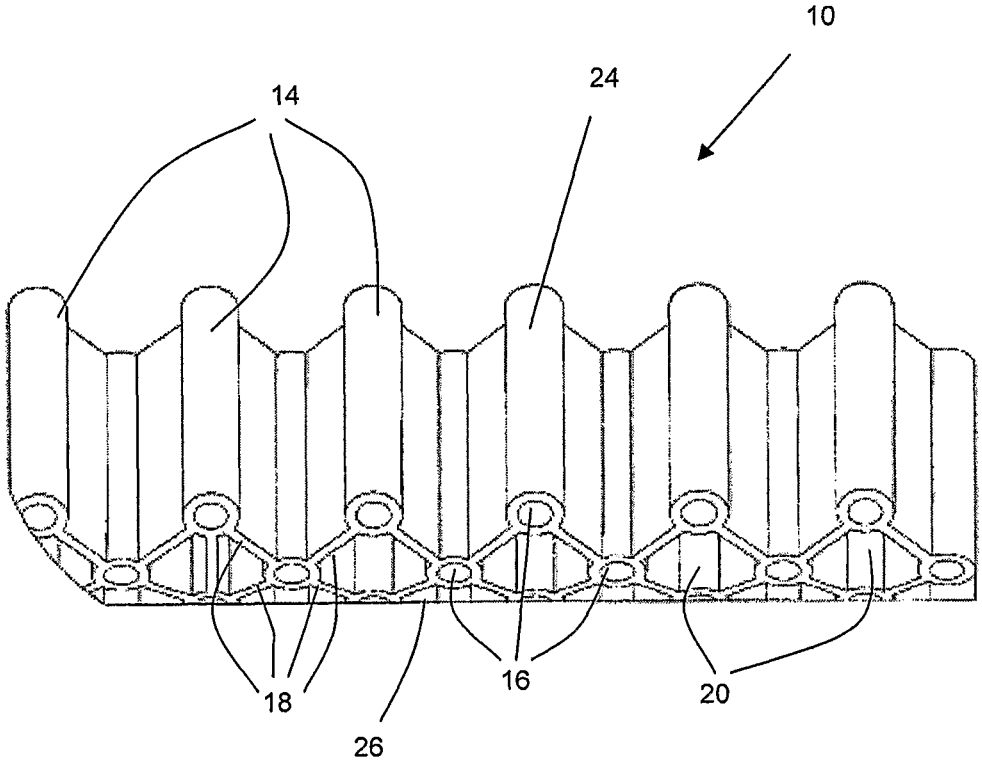
FIG. 4 is a side view of the pad shown in FIG. 1.

With reference to FIGS. 1 to 5, the pad 10 of the first embodiment comprises a structure 12, made from an injection moulded thermoplastic elastomer with a hardness of 42 Shore A, which comprises an array of circular tubular elements 14 arranged with their longitudinal axes in parallel. The tubular elements 14 are arranged in an orderly formation, in rows. The tubes 14 define first passageways 16, the passageways 16 being circular in cross section. The inner diameter of each circular cross section is 5 mm. Each of the tubular elements 14 is connected to other tubular elements 14 by ribs 18, 19. Each tubular element 14 (apart from those at the edge of the pad) generally has four ribs 18 extending from it. The ribs 18 and the walls of the tubular elements 14 are all 2 mm thick. The ribs 18 run in diagonal series across the pad 10. The ribs 18 and the outer edges of the tubular elements 14 together define second passageways 20. The second passageways 20 are generally in the shape of diamonds with corners truncated by the tubular elements 14. The second passageways are arranged in an orderly formation, in rows, and in an alternate manner with the first passageways. When viewed from above, as in FIG. 5, the structure comprises open areas (the passageways 16, 20) and closed areas (the tubes 14 and ribs 18). The proportion of closed area to the total area is approximately 22%.

The spacing between the tubular elements 14, and hence the lengths of the ribs 18, is uniform across most of the pad, between the sides 24. Each rib 18 is 10 mm long. The outermost ribs 19 along the sides 24 are significantly longer than any of the others, as shown in FIG. 5, and, therefore, form third passageways 25, which are of similar shape to the second passageways, but are of greater cross-sectional area.

The pad 10 has an upper surface 22, which is for contact with the user's knee. The upper surface 22 is concave in profile. The bottom surface 26, which is the surface of the pad which in use is nearest to the surface being knelt on, has a flat profile 28 in the centre but at the sides 24 of the pad 10 curves upwards towards the upper surface 22. Therefore, the pad is thinner in the centre 28 than at the sides 24. The portions of the pad with the third passageways are less important for weight bearing, but are important for fit. Therefore, the rigidity of the structure is less important in these areas.

The pad 10 is intended to be used in a specific orientation, with the edge 30 facing towards the upper leg and the edge 32 facing towards the lower leg. The edge 32 has a central curved tapered section 34, so that a central section of the edge 32 is up to half the height of the thickness of the pad 10. This section 34 improves the wearer's comfort by providing a gentler profile for the bottom of the wearer's knee/the wearer's shin to rest against.

Figure 5:
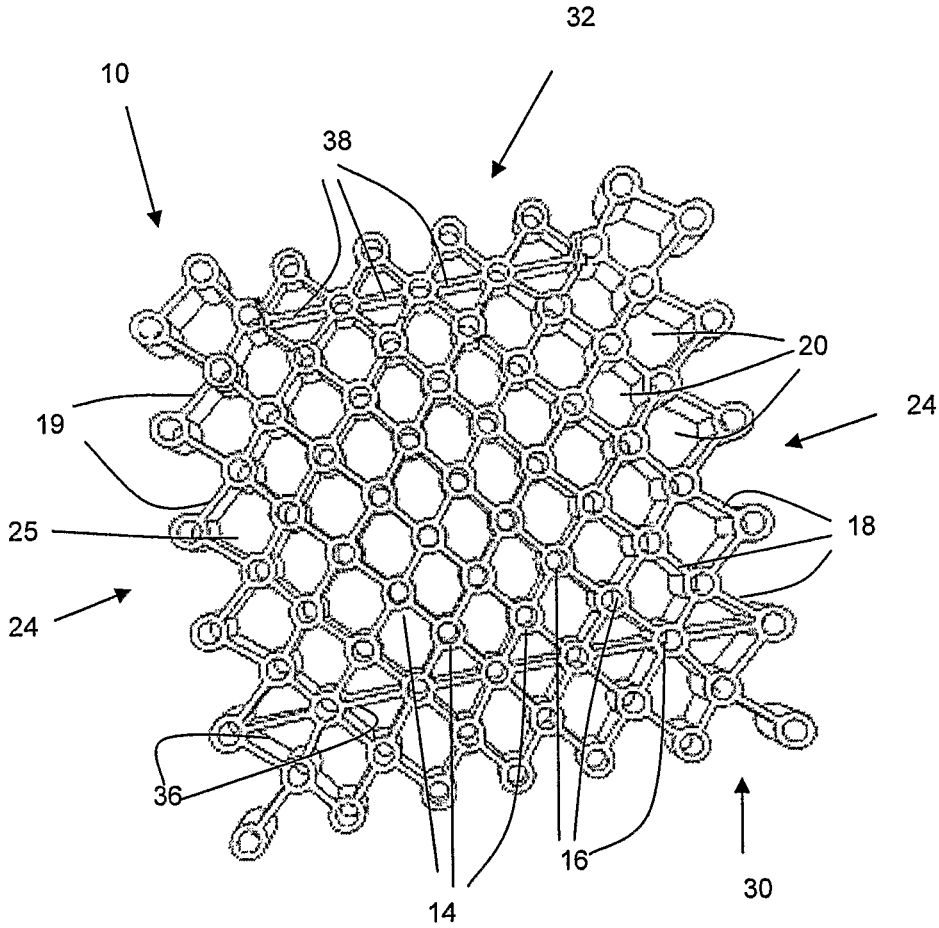
FIG. 5 is a top view of the pad shown in FIG. 1.
Figure 6:
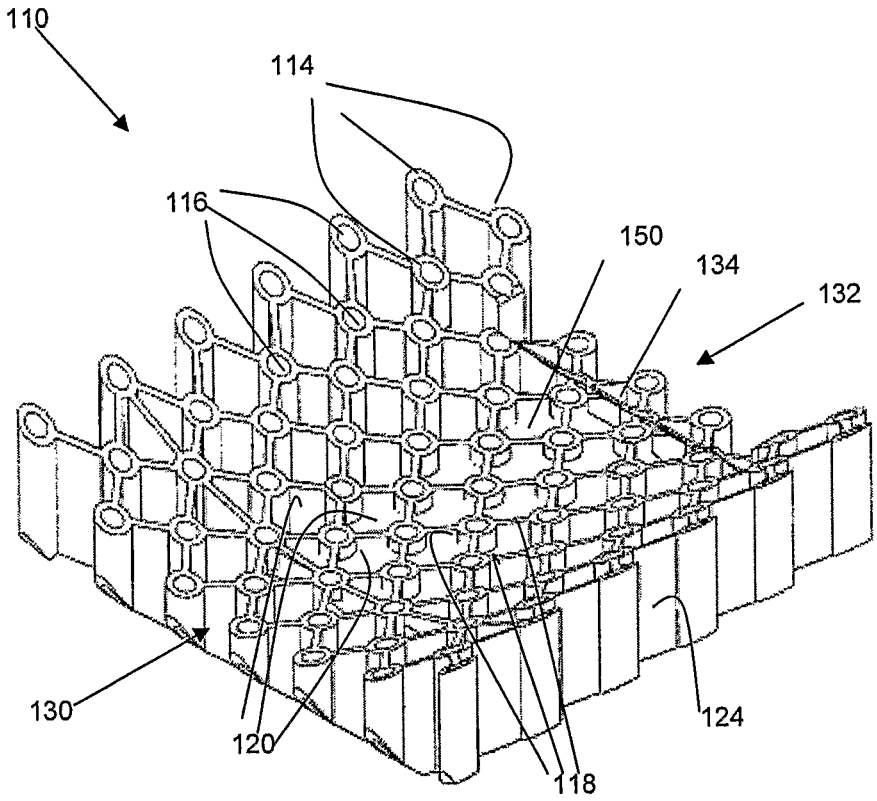
FIG. 6 is a perspective view from above of the pad of the second embodiment of the present invention.
Figure 7:
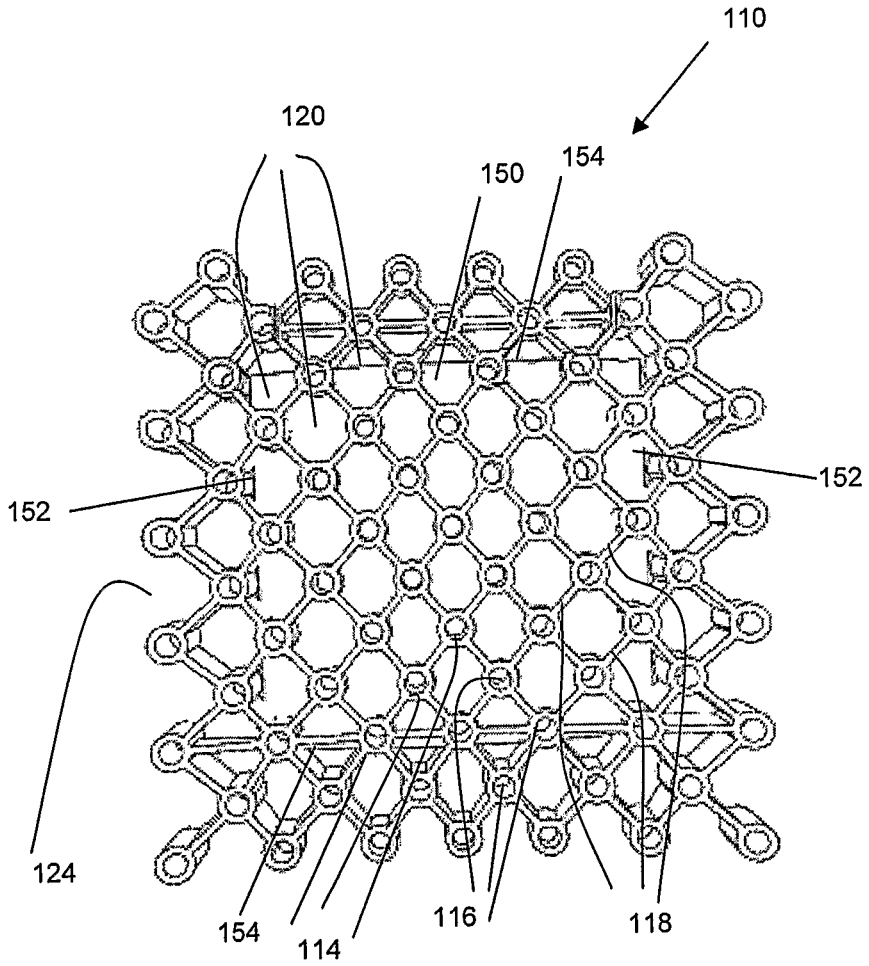
FIG. 7 is a top view of the pad of FIG. 6.

As shown in FIG. 5, two additional series of ribs 36, 38 run close to and parallel to the edges 30, 32, respectively, of the pad. The series of ribs 36 extends across the whole width of the pad, whereas the series of ribs 38 stops short of the sides 24 of the pad 10, and extends only for the width of the section 34.

FIGS. 6 to 9 show the pad according to the second embodiment of the invention. The second embodiment is similar to the first embodiment, and so similar components are denoted by the same reference numerals but with the prefix "1", and only the differences will be described.

Figure 8:
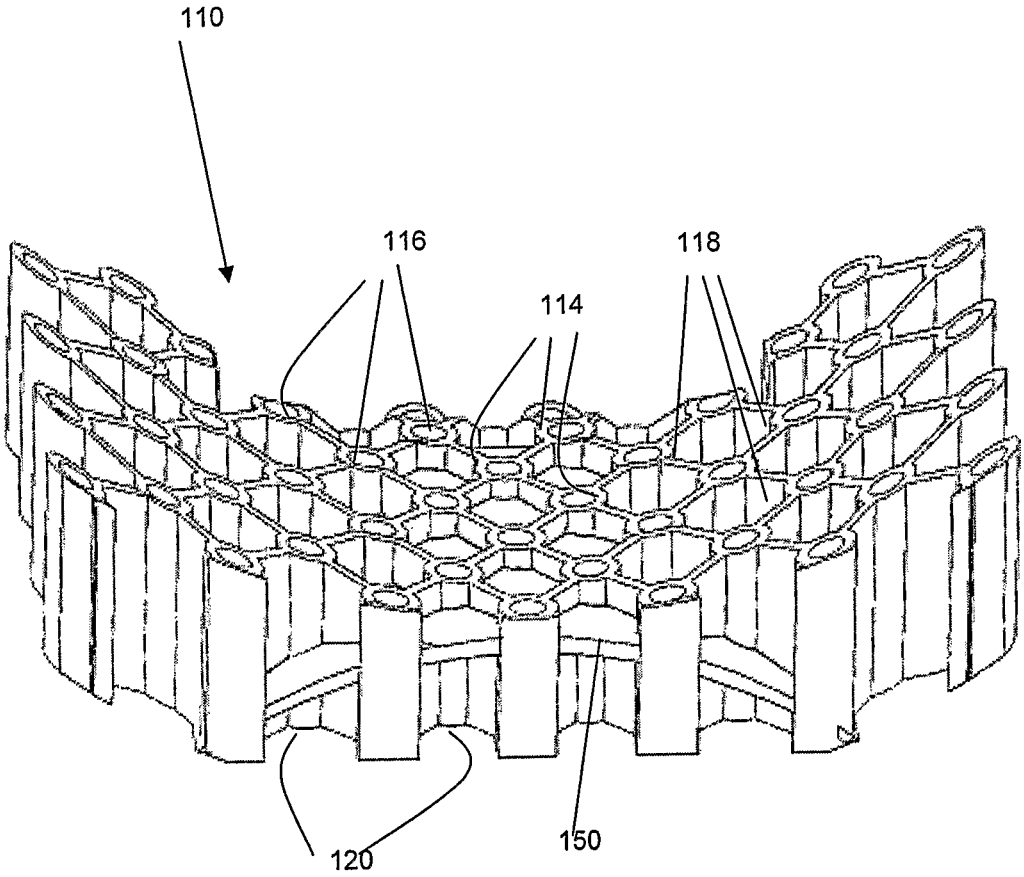
FIG. 8 is a cross sectional view of the pad of FIG. 6, showing the convex profile of the sheet member.
Figure 9:
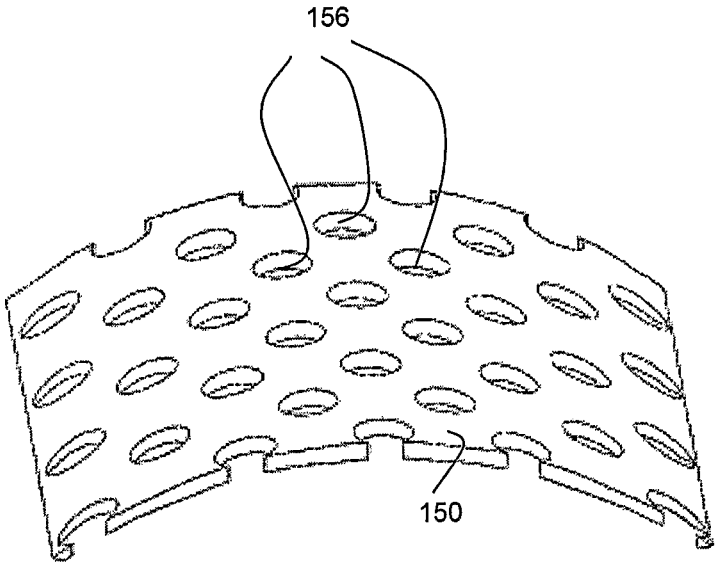
FIG. 9 shows the sheet member of the pad of FIG. 6 without the structure of the pad.
Figure 10:
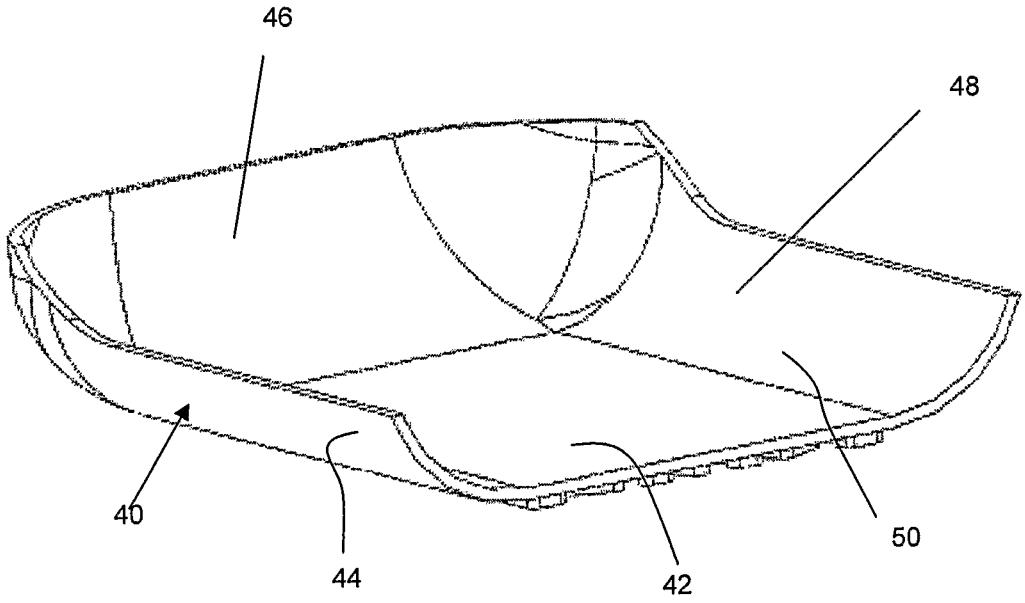
FIG. 10 shows the holder, without straps, for containing the pad and holding the pad against a person's knee.

The pad 110 includes a sheet member 150, in this embodiment made from a thermoplastic elastomer with a hardness of 70 Shore A. The structure 112 and the sheet member 150 are injection moulded. The area of the sheet member 150, when viewed from above as in FIG. 8, is around 35% of that of the whole pad. As shown in FIG. 8 the sheet member 150 is provided centrally in the pad 110. As shown in FIGS. 9 and 10, the sheet member 150 is convex in profile with the apex of the arc of the sheet member 150 facing towards the upper surface 122. The radial centre of the arc defines an axis extending fore-aft, and only extends across the central portion of the pad, where there is most load. The peripheral edge of the sheet member comprises two side edges 152 and two end edges 154. The side edges 152 are parallel with the sides 124 of the pad 110 and the end edges 154 are parallel with the ends 130, 132 of the pad 110. The end edges 154 are convex, and the side edges 152 are arranged to be, in use, parallel to the surface to be knelt on. The thickness of the sheet member at the edges is 1 mm. The thickness of the sheet member in its centre is 3 mm.

In use, the sheet member 150, by joining the ribs 118 and the tubular elements 114, provides extra rigidity to the structure by inhibiting buckling of the ribs 118 and the tubular elements 114, and the concave shape of the sheet member 150 allows it to act as a leaf spring, thus providing further resilience and suspension in the structure 112. As shown in FIG. 10, the sheet member 150 defines apertures 156 which are arranged in an ordered formation so as to align with the passageways 116 inside the tubular elements 114. Therefore, air can still circulate from the knee to the outside of the pad 10, thereby maintaining breathability of the pad 10.

Figure 11:
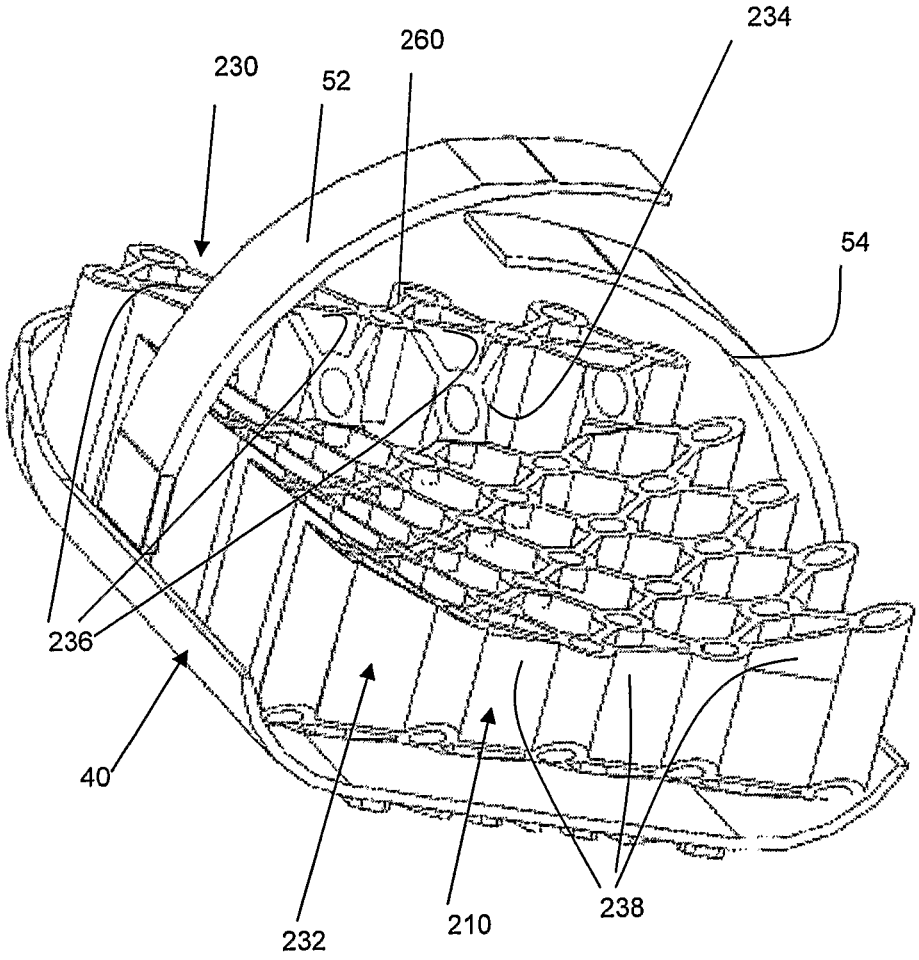
FIG. 11 shows a pad in the holder shown in FIG. 10, with straps.
Figure 12:
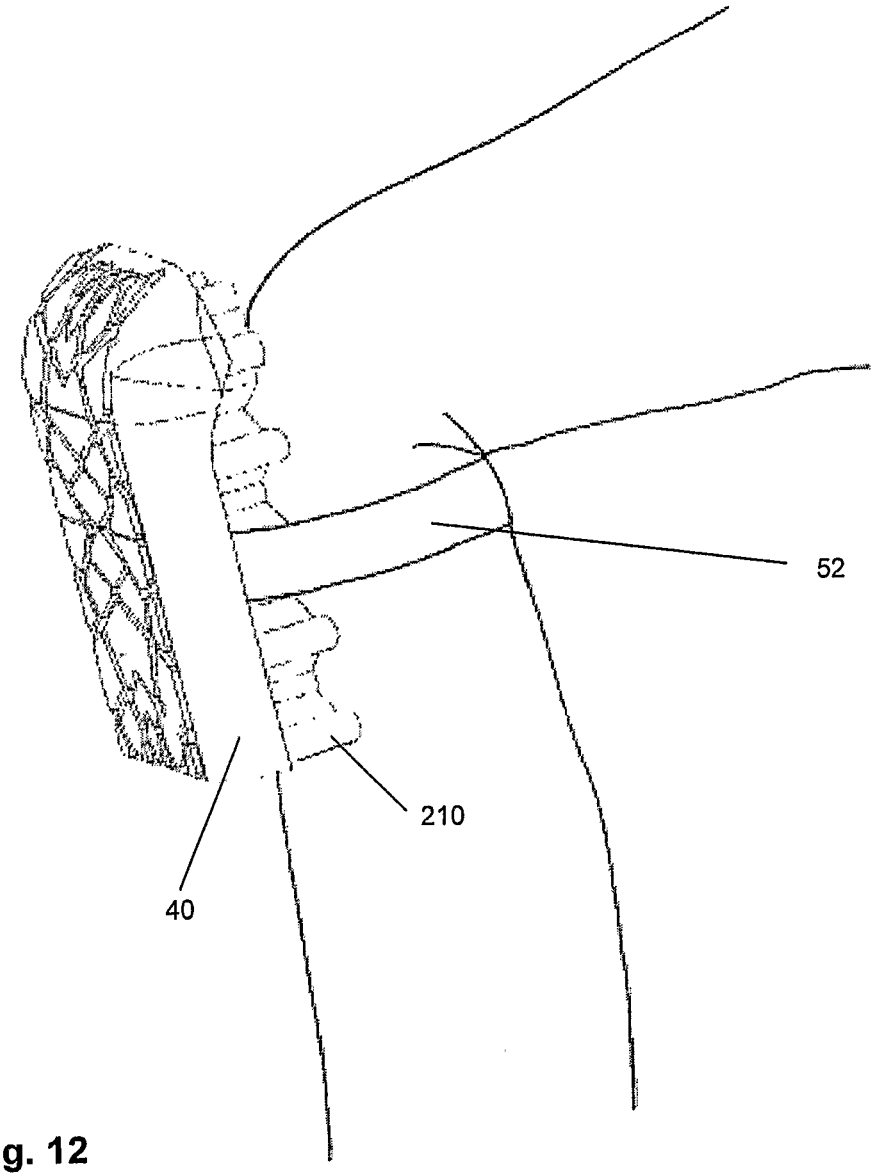
FIG. 12 shows the holder and pad in FIG. 11 in place on a person's knee.
Figure 13:
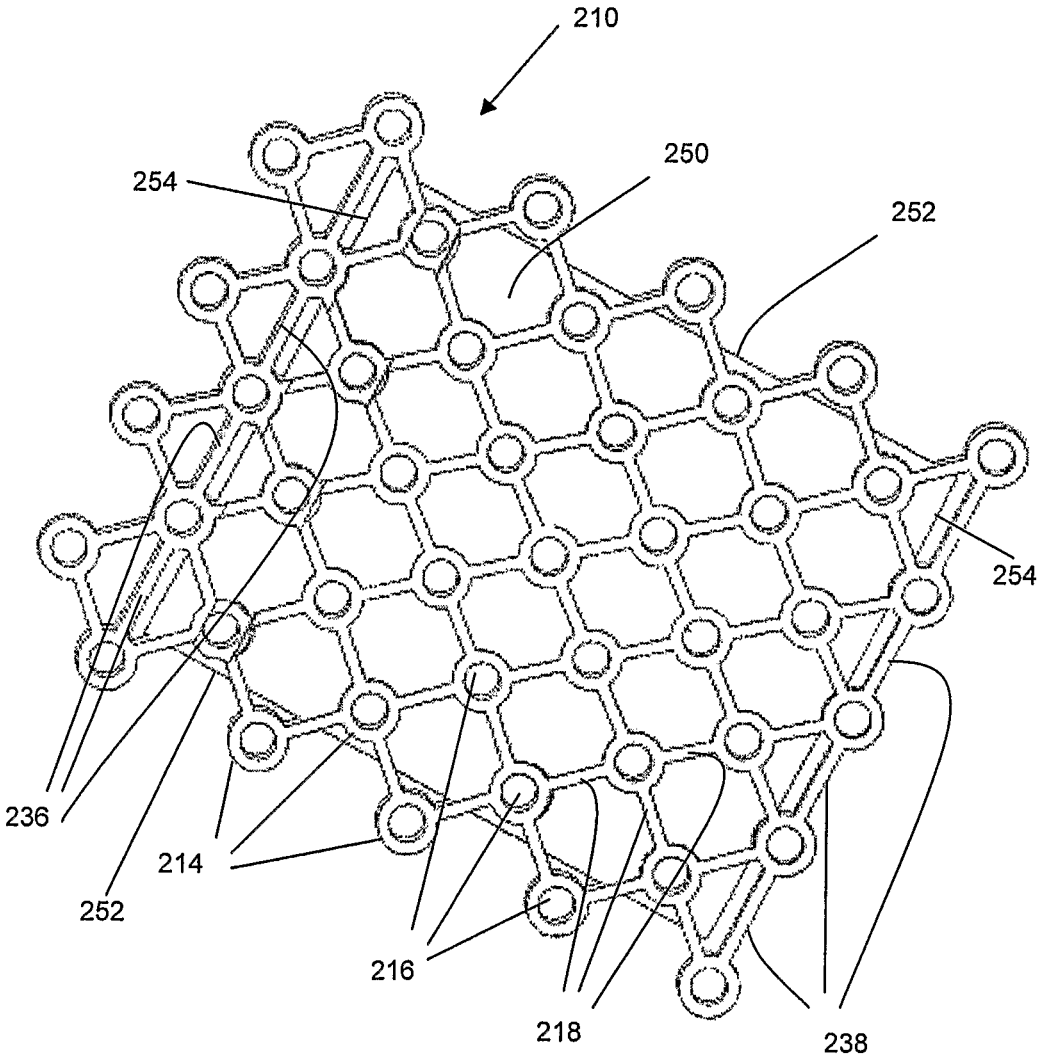
FIG. 13 is a top view of the pad of FIG. 11.

In use, the pad is placed in a holder 40, as shown in FIGS. 11 to 13. The pad 210 shown in the holder in FIGS. 12 and 13, although it has a sheet member, has some differences from the pad 110 of the second embodiment. These differences can be seen in FIGS. 12, 13, and 14. Similar components to the pad 110 of the second embodiment will be denoted by the same reference numerals, but with the prefix "2" instead of "1". Differences from the pad 110 of the second embodiment will be discussed later. The holder 40 comprises a base 42 and three sides, 44, 46, 48. The fourth edge 50 of the base 42 is open. The pad 210 is placed so that the bottom surface 26 is in contact with the base 42 of the holder 40. The base 42 of the holder 40 is shaped in a similar manner to the bottom surface 26 of the pad 10, so that there is a large area of contact between the pad 210 and the holder 40. The holder 40 further comprises straps 52, 54 which, in use, can be used to keep the holder in place around the person's leg. The open edge 50 is arranged to be in use, the edge of the holder facing the wearer's lower leg, so that there are no edges which the wearer's leg presses against, thus improving comfort.

The outer surface of the base the pad 210 has a tapered section 234, but this is not at the edge 232, as in the second embodiment. Rather, the tapered section 234 is nearer the edge 230, and, further, tapers upwards from the upper surface 222 to create a thicker portion 260 along the edge 230. In use, the top of the wearer's knee is in contact with this thicker portion 260 of the pad 210, rather than the edge 46 of the holder 40, thus increasing comfort and stopping the knee from moving over the edge of the pad during use. The pad 210 has two additional series of ribs 236, 238. The series 236 is closer to the edge 230 than in the previously described pads 10, 110, and the series 238 is actually along the edge 232. The closer proximity of the series 236, 238 to the edges 230, 232 increases the stability of the pad 210 in these regions, when a wearer is kneeling on the pad 210. The sheet member 250, when viewed from above, as in FIG. 13, has an area which is about 60% of that of the whole pad 210, and thus is greater in area than the sheet member 150 of the pad 110 of the second embodiment.

Although the use of the pad 10 with the holder 40 has been described, it will of course be obvious that the manner in which pad 10 is positioned to cushion the knee can be varied. For example, a pocket could be created in the knee of a pair of trousers and the pad inserted into the pocket.

Figure 14:
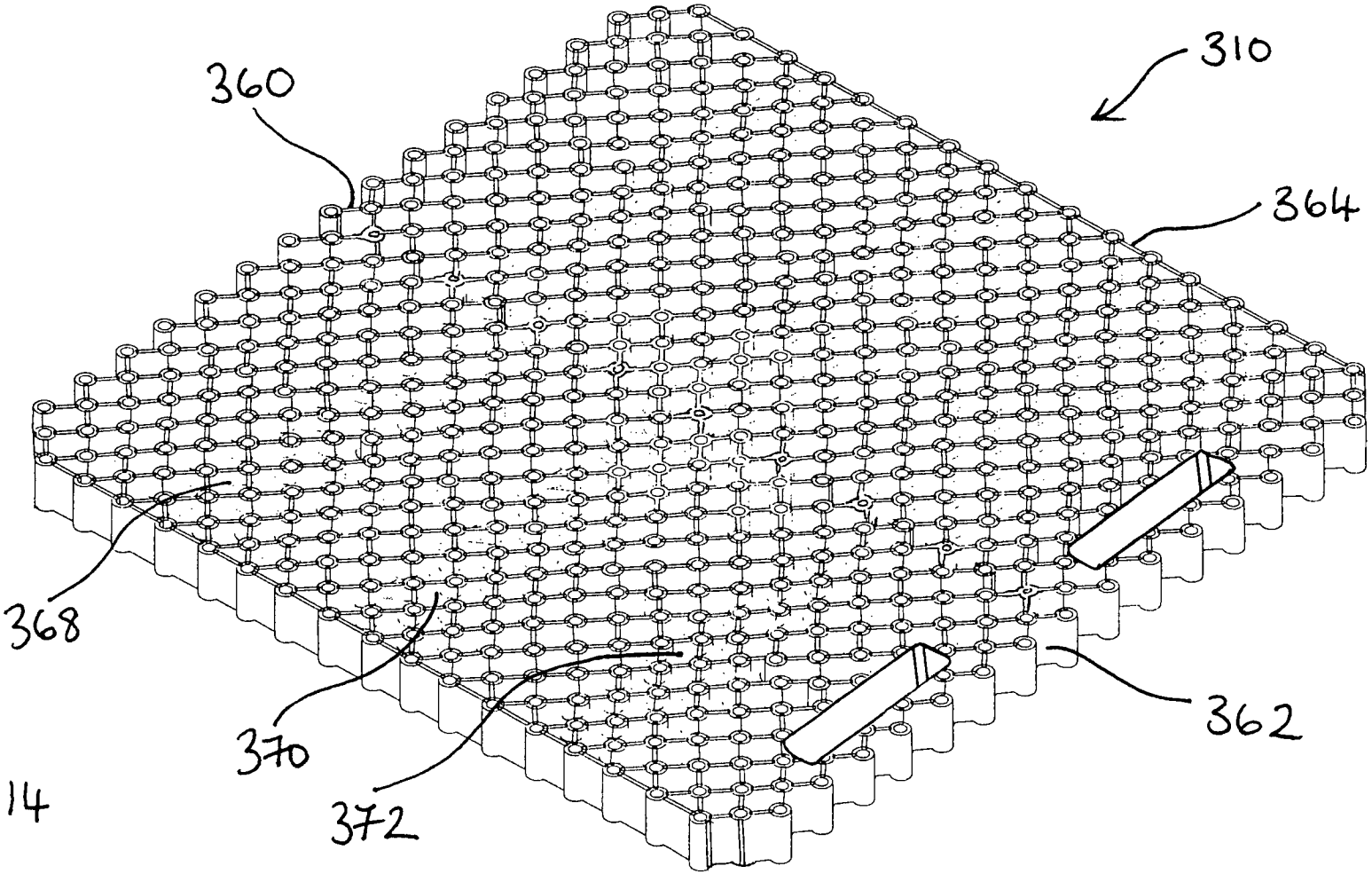
FIG. 14 is a perspective view of the seat pad according to the third embodiment.
Figure 15:
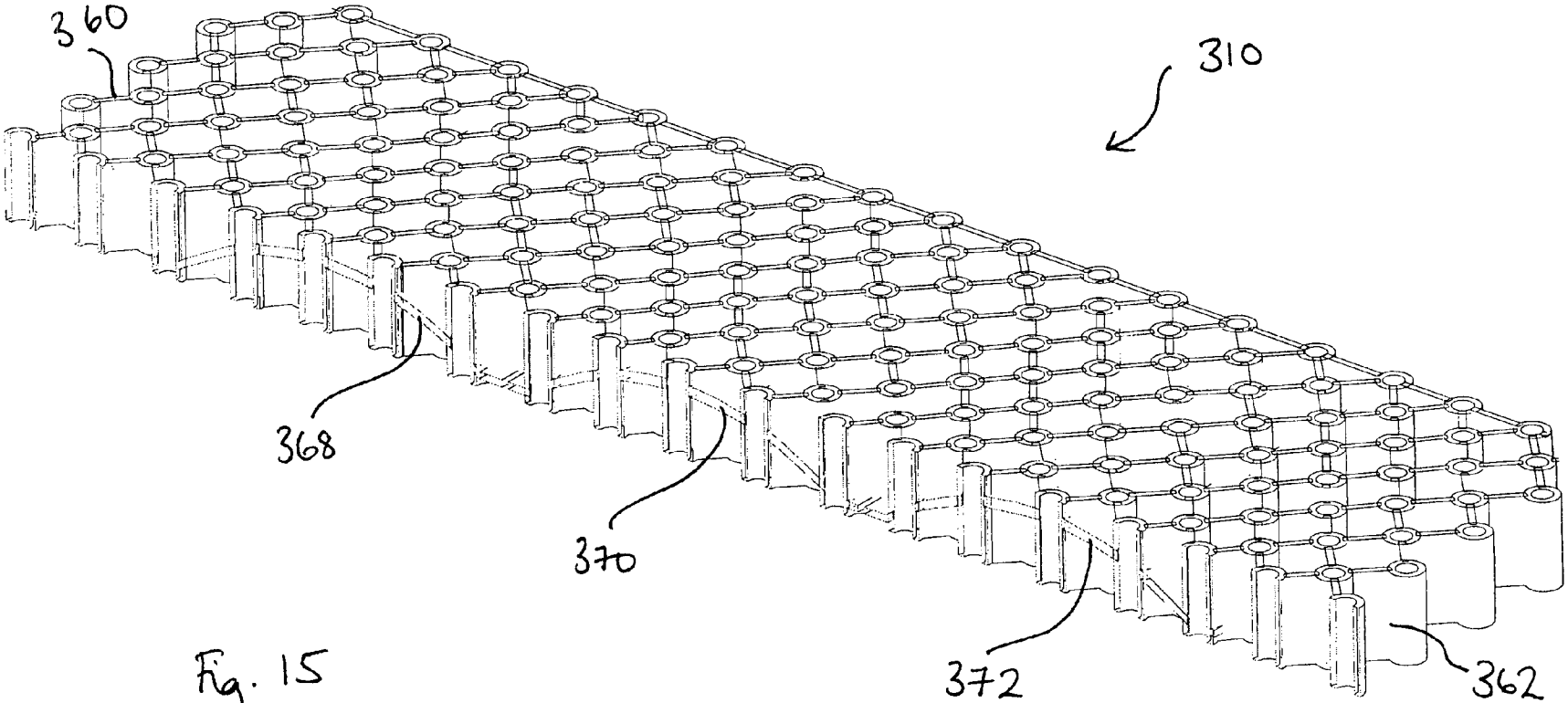
FIG. 15 is a perspective view in cross section of the pad of FIG. 14.
Figure 16:
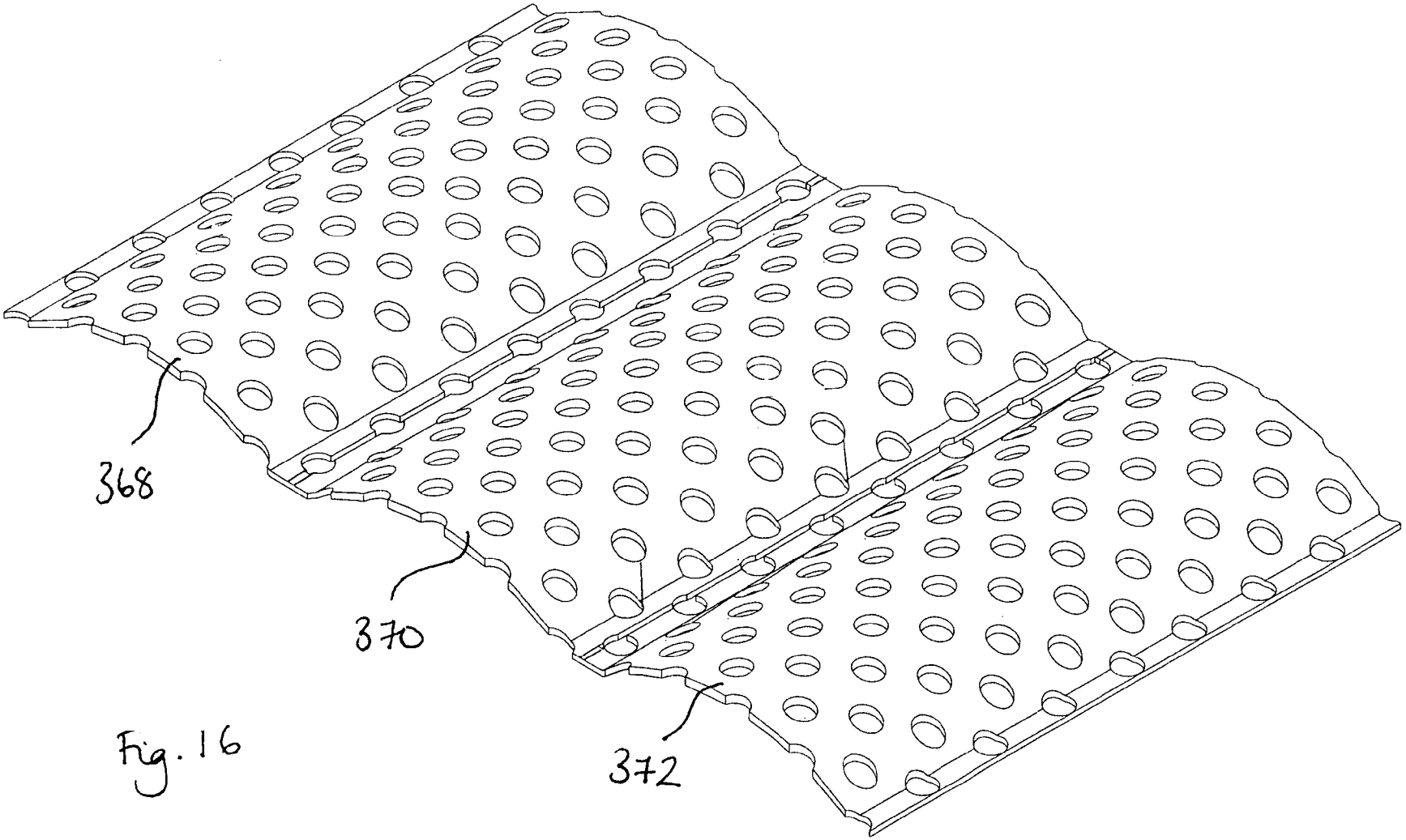
FIG. 16 is a perspective view showing only the sheet members of the seat pad of FIG. 14.

FIGS. 14 to 16 show the pad according to the third embodiment of the invention. The third embodiment is similar to the first and second embodiments, and so similar components are denoted by the same reference numerals, but with the prefix "3", and only the differences will be described.

The pad 310 in this embodiment is significantly larger than those of the previous embodiments, and is of a suitable size for the seat of a chair. The pad 310 has four edges, a front edge 360 which is the edge which are used as legs will overlap in use, a back edge 362, and when viewed from the front, a left edge 364 and a right edge 366.

Instead of the single sheet member as in the second embodiment, the pad includes three sheet members 368, 370, 372. The sheet members 368, 370, 372 are elongate, with the direction of elongation being the same as the direction of the fore-aft axis of the sheet member 368, 370, 372. The sheet members 368, 370, 372, slightly spaced apart and aligned so that their fore-aft axes are parallel to each other and also parallel to the front edge 360 of the seat pad 310.

In the above embodiment relating to a seat pad, the pad has structure which is a continuous moulding, but the pad could also be created from a number of separately moulded sections.

It will be apparent to the skilled man that the number of sheet members in a pad, and their relative arrangement may be varied, particularly in any arrangement which provides comfort for the user.

For example, in the seat pad, more or less than three sheet members may be provided, and there may be no spacing between the sheet members, or a large spacing. Further, each sheet member could be replaced by a plurality of shorter sheet members. the sheet members could also be oriented differently. For example, sheet members could be provided substantially perpendicular to the front of the pad. Sheet members may be positioned to correspond to pressure points likely to be created in use, or may be positioned randomly to provide a level of cushioning throughout the pad. Further, different shaped sheet members may be used, for example, dome shaped sheet members.

In all the embodiments, the tubular elements (apart from those at the edges of the pads) are depicted as being connected by ribs to four other tubular elements, so that four ribs extend from each tubular element. However, a different number of ribs could extend from each tube, for example, eight ribs.

Although in the first and second embodiments, extra series of ribs 36, 38 and 236, 238, respectively, were provided. However, these are not essential, and the pad may be created without these additional ribs.

The tubular elements in the structure of the above described pads are all circular in cross section but, of course, the elements could be any shape in cross section, for example, oval, square, triangular, hexagonal. Further, it is, of course, possible for there to be only one type of passageway in the structure, for example, only square or hexagonal passageways. In this case, no ribs would be needed.

All the passageways in the described pads are arranged to be perpendicular to the surface to which pressure is applied by the user, as shown in the figures. However, the passages could be arranged to be at a different angle to the surface to which pressure is applied.

The sheet member in the second and third embodiments need not be curved in profile, but could be flat. Alternatively, it could also be a dome shape.

The sheet members in the first and second embodiments have areas of 35% and 48% of the total area of the pad, respectively. However, the sheet member could have an area up to 100% of the area of the pad, although typically its area will be between 25% and 75% of the area of the pad.

In the third embodiment, the seat pad is for a chair, but it would be apparent to the skilled may that such an arrangement could easily be adapted to any size of seat, for example bench-type seats found on public transport.

The surface of the seat pad which is to be sat on may be moulded for comfort. For example, the front edge may be tapered so that it does not dig into the back of a user's knees or the sides may have more sections which taper upwardly, to ensure the user is correctly positioned on the seat.

The seat pad could include a lumber support.

A pad, as well as being suitable for a seat, may be suitable for the whole of a chair, for example, a seat portion, a back portion, and even a headrest.

It will be apparent to the skilled man that pads as described above could be adapted without any inventive skill for use in cushioning any body part, for example, elbows, the back, the head, and could even be used as a floor covering. If provided with sheet members, the sheet members would preferably be provided in suitable locations relative to the pressure points in use.

Of course, the pads may include a cover, for example a fabric cover, so that the structure on the pad is hidden from view.

The invention claimed is:

1. A knee pad for cushioning the knee when kneeling on a surface, the knee pad comprising:

a support surface arranged to support an applied load from a user's knee;

a structure defining longitudinal first passageways, each longitudinal first passageway defining a longitudinal axis, the structure being such that the first passageways and longitudinal axes thereof intersect with the support surface;

a sheet member, the sheet member being positioned substantially within the structure, the sheet member being convex in profile, so that an apex of an arc of the sheet member faces towards the support surface and the sheet member acts as a leaf spring, the sheet member being made from a thermoplastic elastomer; and the hardness of the sheet member being greater than the hardness of the structure.

2. A cushioning pad comprising:

a support surface defined by said pad which is arranged to support an applied load;

a structure defining longitudinal first passageways, each longitudinal first passageway being defined by a tubular element defining a longitudinal axis, the structure being such that the first passageways and longitudinal axes thereof intersect with the support surface;

a sheet member, the sheet member being positioned substantially within the structure, the sheet member being convex in profile, so that an apex of an arc of the sheet member faces towards the support surface and the sheet member acts as a leaf spring, the sheet member being made from a thermoplastic elastomer, the sheet member defining apertures which align with centres of the first passageways so that the first passageways are not blocked; and the hardness of the sheet member being greater than the hardness of the structure.

3. A cushioning pad comprising:

a support surface arranged to support an applied load;

a structure defining longitudinal first passageways, each longitudinal first passageway defining a longitudinal axis, the structure being configured such that the first passageways and longitudinal axes thereof intersect with the support surface; and a sheet member, the sheet member being positioned substantially within the structure, the sheet member being convex in profile, so that an apex of an arc of the sheet member faces towards the support surface, the sheet member being made from a thermoplastic elastomer, the sheet member being configured to act as a leaf spring, and the hardness of the sheet member being greater than the hardness of the structure.

4. The cushioning pad according to claim 3, wherein the first passageways are arranged to be positioned, in use, substantially perpendicular to said support surface.

5. The cushioning pad according to claim 3, wherein the first passageways are directly joined to each other.

6. The cushioning pad according to claim 3, wherein each first passageway is defined by a tubular element.

7. The cushioning pad according to claim 6, wherein the sheet member is joined to the tubular elements.

8. The cushioning pad according to claim 3, wherein the structure further defines second passageways of a different size from the first passageways.

9. The cushioning pad according to claim 8, wherein the second passageways are arranged in an alternate manner with the first passageways.

10. The cushioning pad according to claim 8, wherein the first passageways are of a smaller cross sectional area than the second passageways.

11. The cushioning pad according to claim 8, wherein the first passageways are joined via ribs, the ribs and outer edges of the first passageways defining the second passageways.

12. The cushioning pad according to claim 11, wherein the sheet member is joined to the ribs.

13. The cushioning pad according to claim 8, wherein the cross sectional area of each first passageway is less than 25% that of each second passageway.

14. The cushioning pad according to claim 3, wherein a radial centre of the arc of the sheet member defines an axis.

15. The cushioning pad according to claim 3, wherein the sheet member defines apertures which align with centres of the first passageways, so that the first passageways are not blocked.

16. The cushioning pad according to claim 3, wherein the sheet member is made of harder plastics material than the structure.

17. The cushioning pad according to claim 3, wherein the support surface of the pad is for contact with a user and is concave in profile.

18. The cushioning pad according to claim 3, wherein the pad includes more than one sheet member.

19. A cushioning pad for a knee and according to claim 3.

20. The cushioning pad for a knee according to claim 19, wherein the cushioning pad includes sides, and the sides of the pad are intended, in use, to be either side of a wearer's knee are curved in a direction which, in use, is away from a surface being knelt on.

* * * * *